US006210287B1

(12) United States Patent
Briggs

(10) Patent No.: US 6,210,287 B1
(45) Date of Patent: Apr. 3, 2001

(54) INTERACTIVE ARENA PLAY STRUCTURE

(75) Inventor: Rick A. Briggs, Springfield, IL (US)

(73) Assignee: Koala Corporation, Denver, CO (US)

( * ) Notice: Subject to any disclaimer, the term of this patent is extended or adjusted under 35 U.S.C. 154(b) by 0 days.

(21) Appl. No.: 09/154,259

(22) Filed: Sep. 16, 1998

Related U.S. Application Data

(60) Provisional application No. 60/068,181, filed on Dec. 19, 1997.

(51) Int. Cl.[7] ..... A63G 31/00

(52) U.S. Cl. ..... 472/128; 472/136; 273/394

(58) Field of Search ..... 472/117, 128, 472/136, 137; 482/35, 36, 37; 273/394, 395, 396, 397

(56) References Cited

U.S. PATENT DOCUMENTS

| | | |
|---|---|---|
| 1,935,543 | 11/1933 | Coughlin . |
| 3,539,181 | 11/1970 | Larsen . |
| 3,843,127 | 10/1974 | Lack . |
| 4,057,244 | 11/1977 | Gaspar . |
| 4,159,113 | 6/1979 | Callecod . |
| 4,262,900 | 4/1981 | Vinson . |
| 5,194,048 | 3/1993 | Briggs . |
| 5,431,410 | 7/1995 | Hampton . |
| 5,480,336 | 1/1996 | Blanchard . |
| 5,554,074 | 9/1996 | Von Parrish . |
| 5,741,189 | 4/1998 | Briggs . |

FOREIGN PATENT DOCUMENTS

| | | |
|---|---|---|
| 1031693 | 6/1958 | (DE) . |
| 96/29120 | 9/1996 | (WO) . |

OTHER PUBLICATIONS

Braunfelsbilt Products Brochure by New Braunfels General Store International, New Braunfels, Texas.
SCS Interactive Family Adventures Brochure, Discovery Treehouse by SCS Company, Tillamook, Oregon (1997).
SCS Interactive Brochure, The Interactive Water Funh$_2$ouse by SCS Interactive, Inc., Tillamook, Oregon (1997).
SCS Interactive Brochure, The Interactive Waterplay Arena by SCS Interactive, Inc., Tillamook, Oregon (1997).
Innovative Foam Technology, Inc. Product Brochure, Wimberly, Texas.
World Waterpak Association, Splash, Sep. 1989.
Creative Water Play Components by SCS Company, Specialized Components Supply.

*Primary Examiner*—Kien T. Nguyen
(74) *Attorney, Agent, or Firm*—Snell & Wilmer LLP; David P. Wood

(57) ABSTRACT

An interactive arena play structure is provided incorporating a plurality of water and non-water play elements for creating various desired water effects. The interactive arena play structure incorporates a centrally disposed target tower which controls various water effects located within or around the play structure. Play participants are encouraged to compete against one another to actuate various water effects such that they stay dry while their opponents get wet. In addition, play participants are encouraged to cooperate to actuate a special progressive water effect located in a centrally disposed region of the play arena.

41 Claims, 12 Drawing Sheets

INTERACTIVE ARENA PLAY STRUCTURE

RELATED APPLICATIONS

This application claims priority to U.S. Provisional Application No. 60/068,181, which was filed on Dec. 19, 1997.

BACKGROUND OF THE INVENTION

1. Field of the Invention

The present invention relates generally to the field of children's play structures and, in particular, to interactive water play structures for safely entertaining and educating young and intermediate age children and adults.

2. Description of the Related Art

During the past decade, the popularity of the family-oriented water theme park has greatly increased. This increase is due in part to the desire of families to participate in activities which allow relief from the summer heat while providing thrills and entertainment for the entire family.

Until very recently, most water parks were centralized around a few major ride attractions. The most prevalent of the ride attractions is the water slide. A water slide generally allows participants to slide down a twisting or steeply sloping water trough before encountering a splash landing in a wading pool at the end. Other popular ride attractions include surfing wave simulators, log flumes, and white-water rafting.

As can be imagined, these rides are primarily designed to entertain adults and older children. The rides tend to be fast-paced and may sometimes involve a degree of risk of physical harm, particularly to small children. In addition, participants often complain that they spend much more time waiting in line for the rides than they actually spend on the ride itself.

As a result of these drawbacks, many families with small children are relegated to a more static play environment, such as wading pools and smaller structures designed specifically for the younger children. While these areas of the park may be sufficiently entertaining for smaller children, they are seldom exciting enough for adults and older children. Therefore, the younger families who are going to the water theme parks to spend time together, actually end up spending a great deal of time apart from one another in order to allow each of the family members to achieve a satisfactory level of entertainment. There exists a need in the water theme park field for a play structure which can entertain and challenge children and adults of all ages.

SUMMARY OF THE INVENTION

Accordingly, one object of the present invention is to provide an entertaining water play structure that allows and attracts people of all ages to play together. Another object of the present invention is to provide a play structure that is challenging and entertaining for adults as well as small and intermediate aged children. It is yet a further object of the present invention to provide a single play structure and method of play in which the entire family can participate and interact with one another without having to wait in long lines.

In accordance with one embodiment of the present invention, a water play arena is provided for entertaining one or more play participants. The water play arena contains a central target tower which is adapted to actuate special water effects strategically placed among the play participants. The play participants activate the special water effects through the use of various devices, such as a variety of water guns. For example, a play participant may spray a stream of water from a water gun such that a target is struck. Once the target is struck, a controlled valve opens and allows a second stream of water to create a desired water or other effect. By providing targets of various levels of difficulty, play participants of all ages are able to engage in play at the same time and in the same arena.

My U.S. Pat. No. 5,194,048 and related design patent D330,579, both of which are incorporated herein by reference as though fully reproduced herein, first disclosed the concept of "interactive water play" in which play participants can operate any one of a number of valves to adjust the amount of water spraying from one or more associated water effects. Play participants adjust the various valves and can immediately observe the change in the rate of water flowing from the various associated water effects.

Interactive water play allows children to experiment with and learn about causeand-effect reactions using a familiar and entertaining medium, namely water. Small children, particularly, can benefit from the fun learning experiences garnered from such interactive play. See, for example, my copending U.S. application Ser. No. 08/409,133 filed Mar. 23, 1995, and incorporated herein by reference as though fully reproduced herein.

Many large-scale successful commercial water parks now incorporate interactive water play structures of the type disclosed in my U.S. Pat. No. 5,194,048. Families that have patronized these commercial water parks have discovered for themselves the valuable entertainment and educational benefits that interactive play provides. Sales of admission tickets for many such commercial water parks have surged following the introduction of new interactive water play structures.

The present invention expands and improves on my previous inventions by creating a central target area with which many play participants may interact simultaneously. The central target area creates an environment in which all play participants may interact through either cooperation or competition. Thus, the present invention involves all play participants in an interactive, rather than passive, play environment particularly through the use of the common central target region and the creation of desired play effects as "rewards" for successfully activating various targets or objects.

Another aspect of the present invention involves the recognition that play participants should be rewarded for precise placement of a stream of water. Accordingly, the present invention can include a progressing intensity play effect. One example of the progressing intensity play effect is a simulated geyser which increases or decreases in height for each successive target contact within a set period of time. After the set period of time expires, however, the play effect can be reset to start at the beginning again.

These and other features and advantages of the present invention will become readily apparent to those skilled in the art from the following detailed description of the preferred embodiments with reference to the accompanying drawings, the invention not being limited, however, to any particular preferred embodiment disclosed.

DETAILED DESCRIPTION OF THE PREFERRED EMBODIMENTS

Figure 1:
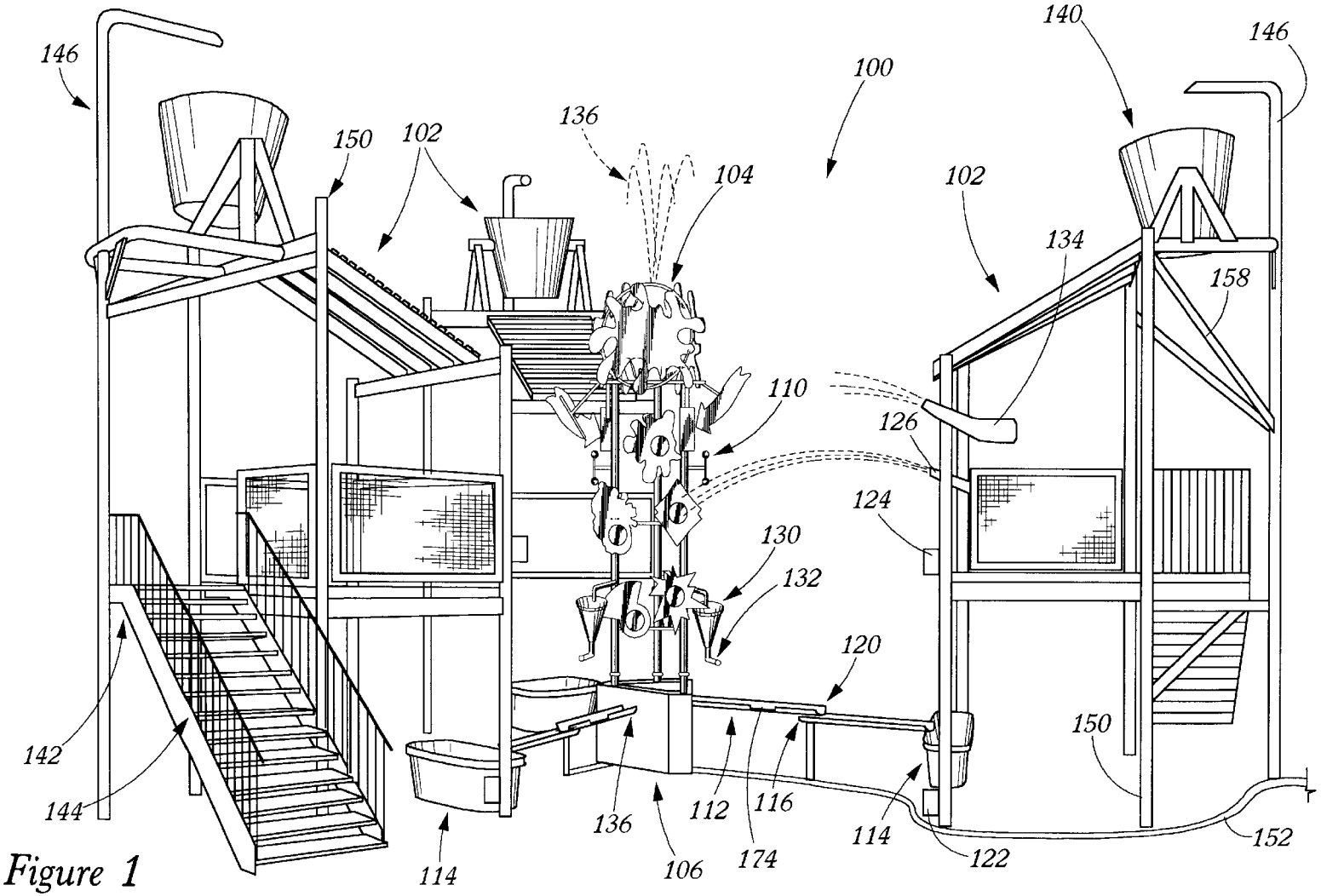
FIG. 1 is a perspective view of an embodiment of a water play arena having features in accordance with the present invention.

For clarity of description and understanding, the following terms used herein shall have the definitions as defined below.

The term "water forming device" will refer to any device, such as a nozzle, from which water or other liquid play medium may be caused to issue.

The term "water play element" will refer to any play element that uses water or another liquid play medium and that may be manipulated or controlled by one or more play participants to create a desired effect, such as spraying, spilling, bubbling, pouring, or splashing water or other liquid play medium, or other effects such as sound effects, ringing bells, sounding buzzers, spinning wheels, or turning on and off lights. Water play elements may include, without limitation, such devices as adjustable water jets, spray nozzles, pump guns, geysers, tipping buckets, and a variety of other water forming elements for spraying play participants or producing various water or non-water effects through play participant interaction.

A "multiple order" water effect may be defined as one in which a later action relies upon the occurrence of an earlier action. For example, pump guns allow play participants to pump water from a pump basin or tub to form a cohesive stream of water which may be directed at a target or other play participants. Before the pump guns may be activated, however, it is first necessary to provide the guns with the required ammunition by filling the pump basins with water. This may be done, for instance, by manipulating another valve or by operating an adjacent water effect in order to fill the pump basin. Thus, the first effect is filling the pump basin and the second effect is causing a stream or spray of water to issue from the water gun. Those skilled in the art will appreciate that the number and variety of such "multiple order" water effects are virtually unlimited.

A "delayed" special effect may be defined as a water or non-water effect which requires action now to produce an effect intentionally timed to occur at a predetermined later time. For example, if a play participant contacts a target which releases a flow of water into a self-tipping bucket, the bucket will eventually fill and tip. However, the bucket does not tip immediately upon the contact with the target. Thus, this would be an example of a delayed special effect.

A "progressing-intensity" play effect may be defined as a water or non-water effect with play participant controlled intensity levels. Preferably, the play participants must repeatedly actuate the play effect to alter the intensity level of the play effect. For example, but without limitation, a simulated geyser can be provided having multiple valves controlling the flow into the nozzle creating the geyser. With each successive contact of an interactive target, the flow rate is increased by the opening of successive valves. The controls may be incorporated into a timed sequence such that the sequence starts over and the valves reset if the sequence is not completed in a set period of time.

Overview of the Play Arena

FIG. 1 is a perspective view of an embodiment of an interactive water play arena 100 having features and advantages in accordance with the present invention. As illustrated in FIG. 1, the water play arena 100 essentially comprises multiple play stations 102 positioned around the perimeter of a centralized target tower 104. The present target tower 104 is located over a center pond 106 and supports several interactive targets 110. The targets 110, in turn, are in electrical communication with solenoid valves on pipes leading to various water play elements located on and around the multiple play stations 102.

As depicted in FIG. 1, the center pond 106 feeds runnels 112 which lead to tower basins 114 located beneath each play station 102. The runnels 112 contain openings 116 or holes. Preferably, the present runnels 112 are provided with dams 120 which must be held open in order to provide a steady stream of water to the tower basins 114. In the closed position, the dams 120 divert the flow of water to the openings 116. The tower basins 114 provide a water source for pumps 122 which carry the water upward into upper basins 124 located on each play station 102. The upper basins 124 provide water to the guns 126 which are strategically placed on each play station 102.

As seen in FIG. 1, the guns 126 can be used to shoot water at other play stations 102, play participants, or the target tower 104. The target tower 104 supports interactive targets 110 which control various water play elements. Activating a specific target on the tower 104 will create a flow of water to a runnel 130. The present funnel 130 and an attached pipe 132 will pour water over the runnel area. Activating another specific target will create a stream of water through a set of jet sprayers 134 located on a play station 102. The present jet sprayers 134 direct a spray of water over the gun region of the play station 102. Activating a third specific target will activate the central geyser 136. As mentioned above, successive activations within a timed interval can increase or decrease the flow rate and, accordingly, alter the height of the geyser reaction. Additionally, activating a specific target will create a flow of water into a bucket 140 mounted above the play stations 102. Preferably, the present bucket 140 will spill its contents when enough water is poured into it as described below.

Each play station 102 is able to be cooperatively operated by a group of play participants to attempt to soak and compete with the other play participants generating other play stations 102. Each of the above-mentioned elements and interactions will be discussed in detail below.

Support Structure for the Play Arena

As illustrated in FIG. 1, the multiple play stations 102 can have multiple levels and/or platforms 142 between which play participants can traverse using stairs 144. In addition, the multiple levels can be connected by ladders, slide poles, slides, climbing nets, or other means commonly used by one skilled in the art.

In the embodiment of FIG. 1, support for the play stations 102 is provided by a supporting framework comprising primarily water-carrying conduits 146 and non-water-carrying faming elements 150. Water-carrying conduits 146 are preferably selected to be of sufficient size and strength to safely support the play station 102 and play participants while also supplying water to the various interconnected water play elements.

Preferably, the water-carrying conduits 146 are formed from hollow steel pipes that are adapted to be bolted, welded or otherwise fitted together using commercially available pipe fittings. Standard Schedule 40 galvanized steel pipe having an outside diameter of between about 4 and 8 inches and a wall thickness of between about ⅛ and ½ inches should be suitable for most applications. Alternatively, some or all of water-carrying conduits 146 can be formed from other suitable materials such as PVC pipe, copper pipe or clay/ceramic pipe, as desired. Additionally, those skilled in the art will readily appreciate that a variety of other materials and joining methods can be used.

Framing elements 150 are selected to safely support non-water play elements and/or to provide additional support for roofing and other optional structures, as desired. Framing elements 150 can be constructed of any convenient material having adequate strength, durability and resistance to corrosion. Aluminum, wood framing, galvanized structural steel, PVC pipe or any other materials known to those skilled in the art can be used, as desired, as framing elements.

It will be apparent to those skilled in the art that a variety of other possible framing designs can be used for constructing the supporting framework. For instance, the supporting framework can be constructed substantially entirely of non-water-carrying framing elements. In that event, water can be provided to the various water effects by separate plumbing conduits that are either external or internal to the framing elements. It is preferred, however, that water-carrying conduits 146 be used for forming substantial portions of the supporting framework in order to reduce costs and to provide fast and easy construction.

The play arena depicted is of a more generic nature which easily lends itself to cosmetic alterations to create a desired play theme. For visual appeal and added safety, optional decorative panels and/or roofing elements can be provided, as desired, to complement the particular desired theme of the particular water play arena, to shade play participants from the sun or to prevent play participants from falling off the play stations. These optional panels (not shown) can be made from wood, fiberglass, reinforced fabric, PVC, or other corrosion-resistant materials, as desired. Those skilled in the art will readily appreciate that a wide variety of other decorative or thematic elements can be incorporated into the overall design in order to provide added safety or convey a particular desired play theme. For example, a medieval castle, lost temple, military fort or fire station can each provide an exciting play theme for an interactive play structure having features and advantages as taught herein.

Center Pond and Geyser

The illustrated play arena of FIG. 1 features three play stations 102 placed around the perimeter of a centrally located target tower 104. Preferably, at least two play stations 102 are disposed around the circumference of the target tower 104. As shown in FIG. 1 and indicated above, the target tower 104 is located above a center pond 106. The present play arena 100 has a geyser 136 located within the frame work of the target tower 104 such that, when activated, the geyser 136 sprays upward within the tower 104 simulating an oil geyser, for example. Notably, the water could also include dies or the like to create slime, luminescence, glow-in-the-dark effects or other similar effects well known in the art.

In the present play arena of FIG. 1, the geyser 136 is connected to a plurality of subterranean supply conduits 152 which provide water to the water play arena 100. The present geyser 136 provides a steady feed of water to the center pond 106. The steady feed of water both supplies the water necessary to keep the water play going and releases some of the water pressure created by the water flow being stopped while the pump continues to attempt to pump water into the water play arena 100. The geyser 136 is activated by a series of target strikes as will be discussed in detail below.

Target Tower Framework

As shown in FIG. 1, the present target tower 104 is preferably located in a central position among all of the play stations 102 of the water play arena 100. The present target tower 104 also includes a side which is substantially parallel to the front of each of the play stations 102. For example, if there are three play stations 102, as illustrated in FIG. 1, the target tower 104 preferably contains three sides which are positioned such that one side faces each play station 102. The target tower 104 is assembled with a framing structure similar to the framing structure of the play stations.

Figure 2:
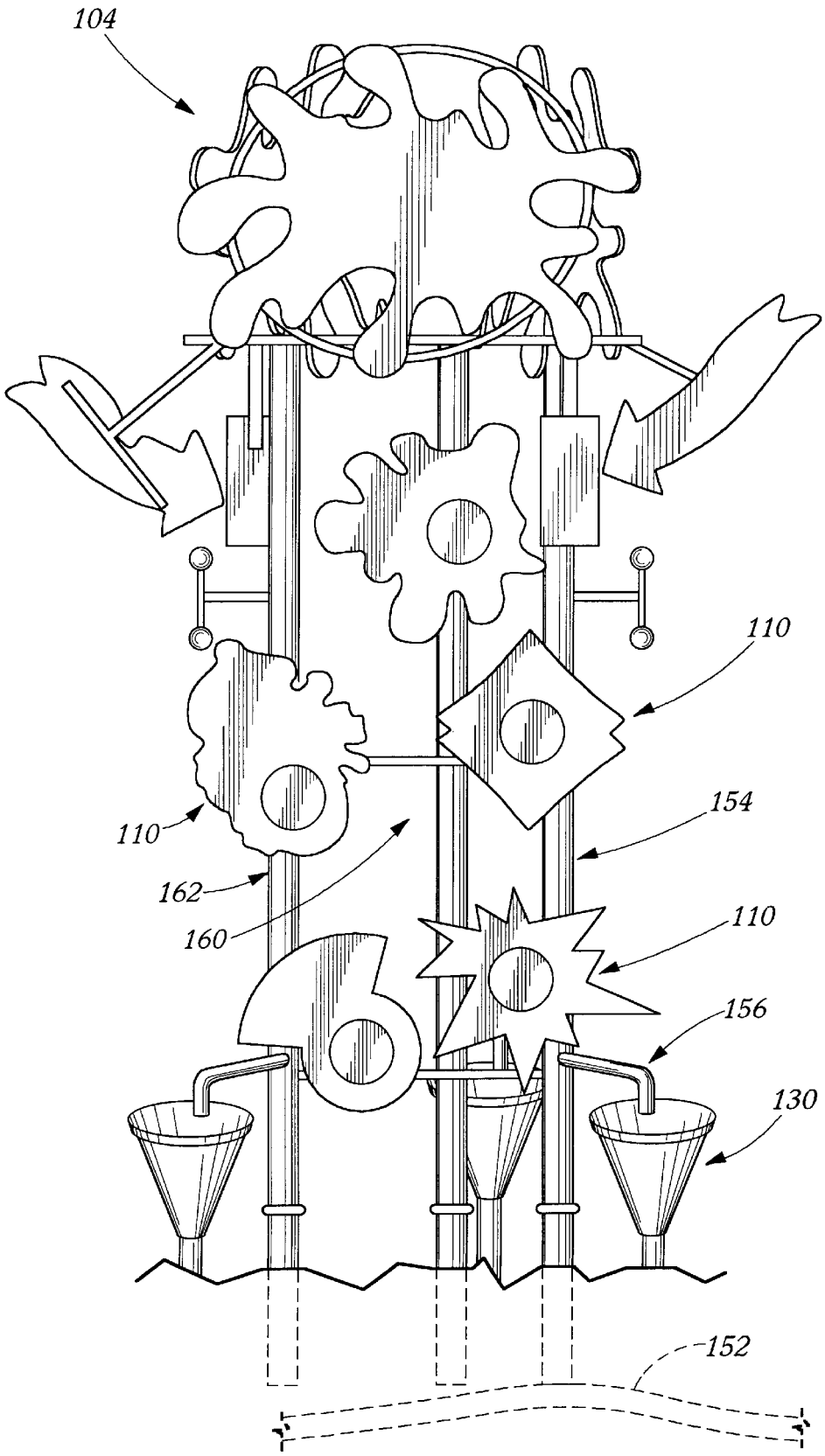
FIG. 2 is a side elevational view of the target tower of FIG. 1.

Each leg 154 of the present target tower 104, as depicted in FIG. 2, is preferably a water-carrying conduit. The leg 154 conduits are advantageously in fluid connection with subterranean supply conduits 152 which supply water to the water play arena 100. The present leg 154 conduits are provided with an outlet 156 to a funnel 130. The outlet 156 is desirably a spigot which can direct a flow of water in a generally downward direction. The flow through the leg 154 conduit is controlled by an interactive target and solenoid valve as will be discussed in detail below.

As seen in FIG. 2, the present target tower 104 is provided with cross-bracing 160 as necessary to provide the required lateral support to each of the legs 154. Additionally, the present target tower cross-bracing 160 advantageously provides locations for the mounting of a plurality of interactive targets 110. The present targets 110 are mounted on the cross bracing by conventional mounting means, such as nut and bolt combinations and/or brackets and the like. The function of the targets 110 will be further discussed below. The electrical lines leading to and from the targets are preferably carried within a separate conduit 162 which is attached to one of the legs such that the electrical lines are shielded from the water. The carrying of the electrical lines within the separate conduit 162 also serves aesthetically to create and maintain a safe and clean visual appearance of the structure.

Runnels and Dams

As mentioned above, each play station of FIG. 1 is linked to the center pond 106 through a series of water-carrying runnels 112. The water-carrying runnels 112 channel water from the center pond 106 to the outlying tower basins 114 which are located adjacent to each play station 102. As shown in FIG. 1, the runnels 112 are generally comprised of a plurality of slightly sloped trough shaped channels. The channels are preferably slightly overlapping at different elevations. One skilled in the art will readily recognize that the runnels may also be formed of a single downwardly sloping surface such that water is carried from a source to a receiving reservoir.

Figure 3:
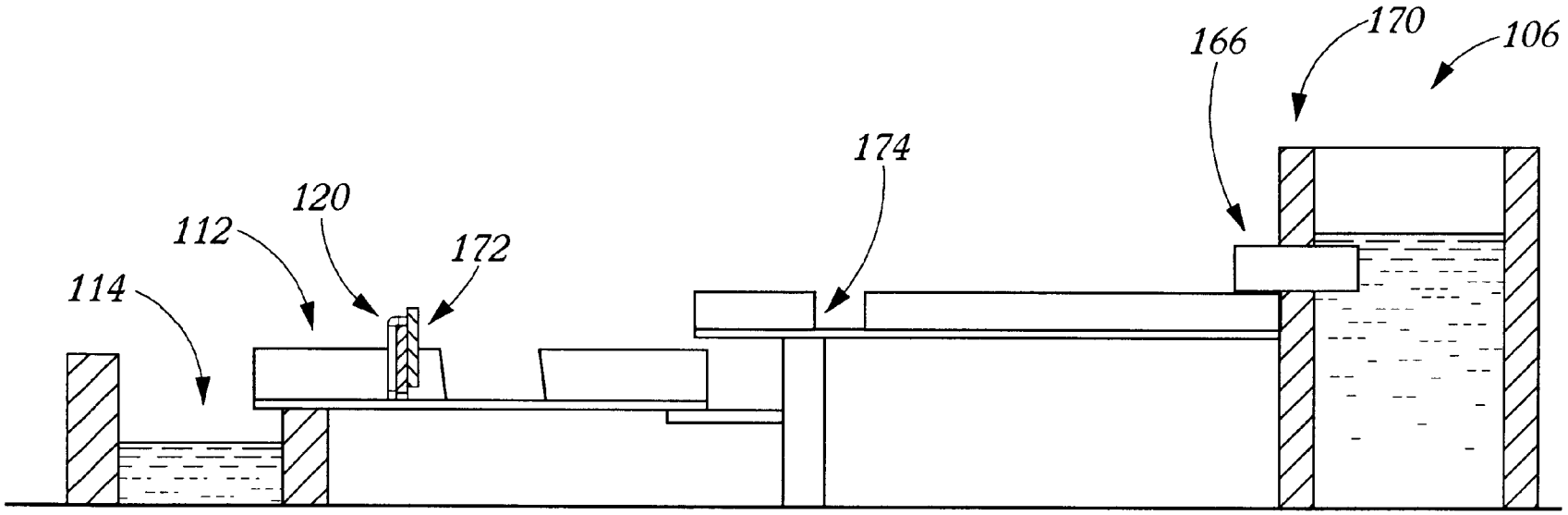
FIG. 3 is a sectional side elevational view of the runnels and dams of FIG. 1.
Figure 4:
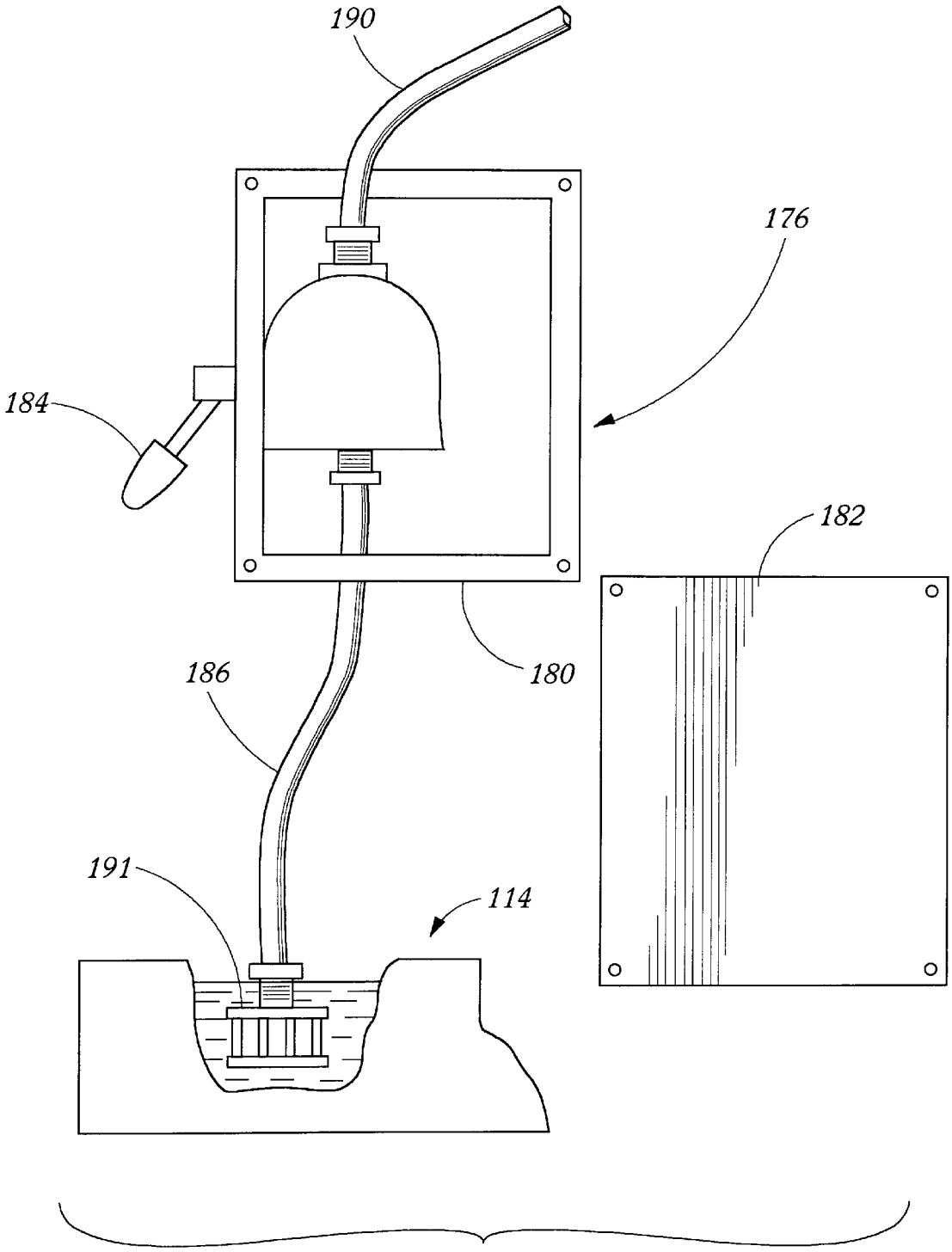
FIG. 4 is a partially exploded front elevational view of the bilge pump of FIG. 1.

In a present embodiment, water preferably flows from the center pond 106 through a set of pipes 166 which extend through the pond walls 170 as shown in FIG. 3. As such, a pipe extends out of the pond generally in the direction of each play station. In a presently preferred embodiment, three 2-inch diameter schedule 40 pipes 166 extend through the pond wall 170 at approximately 120° from each other. The pipes 166 may be provided with a stop valve or plate to stop the water flow or restrict the flow as desired.

As discussed earlier, the water flows from the center pond 106 through the pipes 166 into the runnels 112. As illustrated in FIG. 3, the water-carrying runnels 112 may also contain dams 120 at selected locations. The dams 120 are presently located adjacent to openings in the sides or bottoms of the runnels 112. The dams 120 provide closures for the holes in the present runnels 112.

The present dam 120 is desirably manufactured of corrosion resistant materials. In particular, a mounting frame and hinge pins are preferably manufactured of a stainless steel alloy. The present dam gate 172 is manufactured out of about ½ inch UHMW plate. As shown in FIG. 3, the dam gates 172 are preferably pivotably mounted in a three sided frame preferably manufactured from about 1×1×⅛ inch stainless steel angle. The width and height base of the mounting frame are determined in part by the width of the runnel 112 and the height of the dam gate 172. The present frame is about 12 inches wide and about 4 inches tall.

Atop of each frame side member is welded a stainless steel tube measuring about ⅝ inch O.D.×⅜ inch I.D. and which is about 1 inch long. The through holes of the two tubes define a pivot axis for the dam gate 172. The dam gate 172 pivots through the use of two hinge pins.

The hinge pins are sized according to the I.D. of the tubes on the frame. The present pins are preferably ⅜ diameter stainless steel round stock cut to a length of about 1¾ inch. The present pins are welded to a center portion of a 2 inch long piece of 1⅛×¾ stainless steel flat bar. The present flat bars have two holes which are about 9/32 inch in diameter. The present holes are sized to accommodate two ¼×1 inch button head screws which are used to affix the pins to the dam gate 172. The screws are each preferably provided with 2 washers and a nylock nut.

The present dam gate 172 is manufactured of ½ inch UHMW plate as mentioned above. The present gate 172 is about 11½ inches wide by about 8½ inch tall. As shown in FIG. 3, the top portion of the gate 172 may be contoured to form a handle. The hinge pins are preferably assembled onto the gate 172 such that the gate will substantially block a flow of water when placed in the runnel 112 and closed.

When assembling the dam 120 into the runnel 112, the dam 120 is slid downstream from an opening such as side outlet 174 as shown in FIGS. 1 and 3. The frame of the dam 120 is then welded to the runnel 112. Alternatively, as will be appreciated by one skilled in the art, the frame may be affixed by mechanical fasteners or other well known means, such as, but not limited to adhesives, screws, nails, rivets, bolts, and clamps. Note that the dam gate 172 is preferably on the upstream side of the frame such that the water flow tends to keep it in the closed position. Also, due to the location of the pivot axis and the center of gravity, the gate 172 closes under its weight when not held in the open position by a play participant.

Thus, to create a flow of water from the center pond 106 to the tower basins 114, the dams 120 must be opened by one or more play participants to allow the flow of water along the runnels 112. The present dams 120 can require either intermittent or continuous attention to ensure that the openings remain open and the water flow is maintained.

The runnels can be replaced by, for example, but not limited to, pipes, tipping trays, any of a number of conveyor type devices, a play participant bucket brigade, or a variety of other well-known water-conveying devices. Additionally, the dams 120 can alternatively be replaced by slide plate plugs or other sealing members which may totally or partially close holes in the runnels. One skilled in the art will readily appreciate that many other variations on the transfer means can be utilized.

Lower Pumping Stations and Pumps

As indicated in FIG. 1, after water is transferred to the tower basin 114 from the center pond 106, the water can be carried upward to an upper basin 124. This transfer can be achieved through a variety of methods known to those skilled in the art. In the preferred embodiment, a play participant operates a bilge pump 176 in order to complete the transfer to the upper basin 124. As will be appreciated by one skilled in the art, a play participant can also operate a farm pump to draw water upward into the upper basin 124. Alternatively, any number of methods and devices known to those skilled in the art can be used to complete this transfer. The transfer of water, regardless of the method used, is preferably continuous although those skilled in the art will also recognize that the steps can be broken into separate timed or untimed competitions.

The bilge pump 176 uses any of a variety of pump mechanisms known those skilled in the art. The present pump mechanism is an Edson #254 BR 150 pump. The pump mechanism is preferably mounted within a pump housing 180 using ¼×1 stainless steel bolt head screws with nylock nuts. As one skilled in the art will readily recognize, the pump may alternatively be mounted using a variety of mechanical and/or non-mechanical fastening techniques.

The pump housing 180 provides protection from the elements and further shields the play participants from the working components. The pump housing 180 is preferably manufactured from 10 gauge stainless steel. A face plate 182 for the housing is preferably manufactured from ⅜ inch acrylic sheeting. In a preferred embodiment, the face plate 182 is removably affixed to the housing 180.

The input shaft of the pump mechanism extends through the pump housing. An operator handle 184 is attached to the pump input shaft in a manner known in the art. Additionally, hoses extend through the housing. The present preferred hose is a 1½ inch PVC hose. An input hose 186 is preferably attached to the suction end of the pump mechanism while at least one discharge hose 190 is preferably attached to the discharge end of the pump mechanism. The input end of the present input hose is provided with a strainer to filter foreign objects from the flow of water entering the pump.

The strainer is preferably a cage manufactured in a corrosion resistant material such as, but not limited to, stainless steel, polymers, or after suitable materials. The present cage is basically comprised of an upper plate and a lower plate having ⅛×½ flat bars about 1 inch in length welded between them such that the plates are about 1 inch apart. The present upper plate is provided with a through hole to receive a 1½ inch stainless steel half coupler. The half coupler is affixed to the input end of the input hose 186 described above. The present strainer is submerged below the water level in the tower basin 114.

An alternative to the bilge pump may be a farm pump mounted on the upper deck of the play station. In this embodiment, a plastic farm pump, such as, but not limited to, a Campbell Pump #WP2, is preferably used. A primer hose extends from the upper basin to provide a source to prime the pump as needed. In addition, the farm pump is mounted to the floor of the upper platform through the use of a mounting post in a manner known to those skilled in the art. Preferably, 2 inch schedule 80 PVC pipe extends between the pump inlet, or the inlet to the mounting post, and the strainer in the tower basin. Desirably, a 2 inch bronze swing check valve is placed between the strainer and the input end of the piping.

Compression Guns

After the transfer of water to the upper basin 124 has been completed, the play participants can then make use of the water in a variety of ways. In a preferred embodiment, the water is utilized as ammunition for one or more compression guns 192. As will be appreciated, any type of water gun can make use of the water. In addition, the water contained in the upper basin 124 can be thrown, dumped, ladled or used in a similar method by the play participants.

Desirably, the present play stations are provided with multiple water guns to enable multiple participants to interact concurrently. The present play station is advantageously provided with five water guns; however, the number of guns may be increased or decreased to suit the play environment sought to be achieved. Additionally, the present water guns may receive many alternative ornamental designs to complement the theme of the water play arena. By way of example, but without limitation, a pirate or fort theme may be complemented through use of cannon-style guns while a futuristic city may incorporate laser-style guns. Also, while the present guns are described as mounted to the deck, the guns may alternatively be mounted from the roof, the rafters, or the handrail. Also, the guns may be tethered to the water supply such that they may be carried or moved with a pre-determined range of motion.

Figure 5:
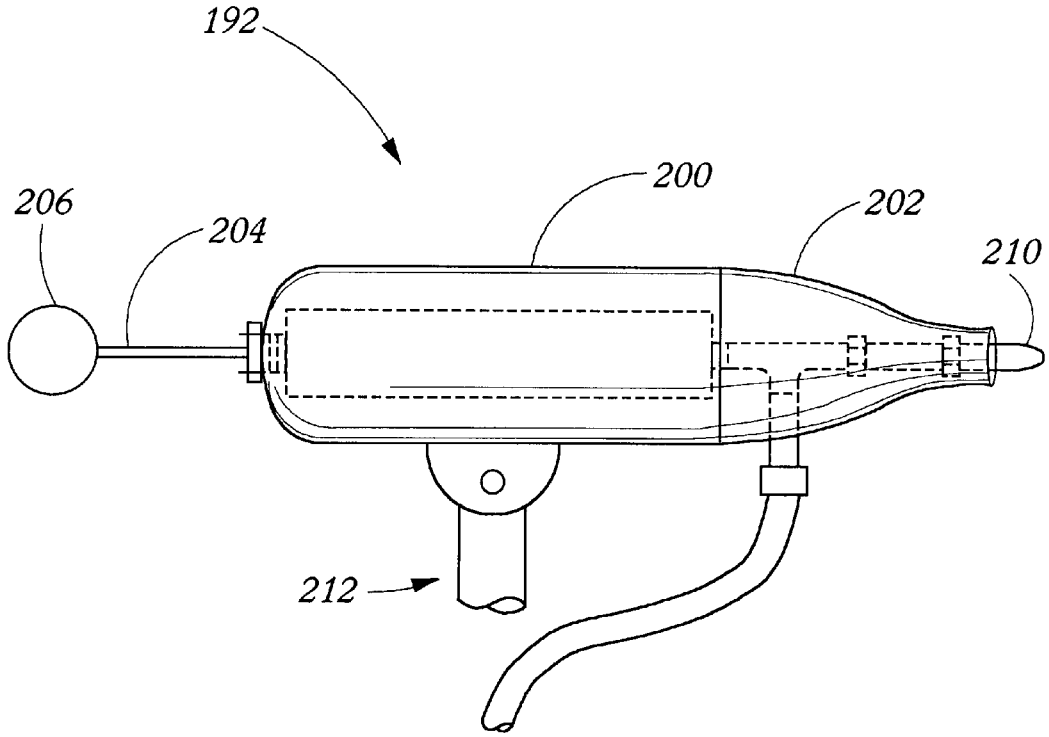
FIG. 5 is a side elevational view of the compression gun of FIG. 1.
Figure 5:
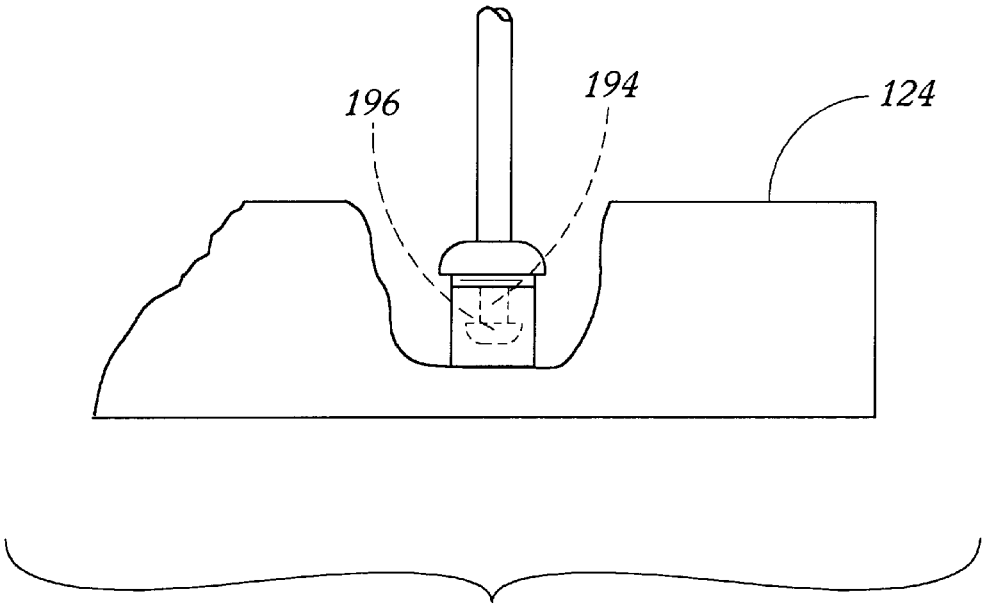

As illustrated in FIG. 5, the present compression gun 192 generally comprises a housing 200, which substantially encases a cylinder tube, and a reducer 202, which substantially encloses the input supply line and output nozzle of the compression gun. The present cylinder tube holds a bimba cylinder having a 1½ inch bore with a 12 inch stroke. The actuator 204 of the cylinder preferably extends through the rear of the cylinder tube and the housing 200. The present actuator 204 is desirably provided with a handle 206 for the play participants to operate the compression gun 192.

The other end of the cylinder is desirably provided with a ½×1½ brass nipple which extends through the front of the cylinder tube and housing 200 into the reducer 202. Presently, a ½ inch brass tee is affixed to the brass nipple and couples the bimba cylinder to the input supply line and an output. The output preferably comprises a ½ inch Deltrol Check Valve #CMMQ30B which is modified by removing the spring. The check valve ensures that air and water are not pulled backward as the play participant prepares to fire the compression gun 192. The output end of the check valve is presently coupled to a ½ inch NPT×⅜ inch brass hose barb 210. Compressed water will emerge from the hose barb 210 to spray whatever the compression gun is aimed at.

The housing 200 pivotably connects the compression gun to a swivel base 212. The present swivel base 212 provides a side to side sweep range of about 180°. Additionally, the pivotable connection provides an up and down range of about 90°. The swivel base 212 is manufactured from corrosion-resistant materials and is constructed in a manner known to those skilled in the art.

The present compression gun 192 preferably has a filtered input. The filtered input desirably comprises a 2 inch schedule 40 stainless steel nipple which is about six inches long. The nipple is cut in half to function as an input housing with the threaded end serving as the output end of the housing as illustrated in FIG. 5. The threaded end desirably receives a 2 inch schedule 10 stainless steel screw cap with about a 1¹⁄₁₆ inch hole in the center. A ½ inch stainless steel full coupling is welded into the center hole and defines a flow path through the screw cap. A Deltrol ½ inch check valve 194, which is modified by removing the spring, is mounted to the full coupling inside the housing. A preferred Deltrol check valve 194 has a length of about 2¹⁄₁₆ inches and a hex dimension of about ⅞ inch. The flow rate achievable through the preferred check valve 194 is about 10.0 GPM with a maximum operating pressure of about 2,000 PSI. Additionally, the preferred check valve 194 has a standard cracking pressure between about 1 PSI to about 2.5 PSI.

To the input side of the check valve 194 is a ½ inch suction screen 196. The present suction screen is manufactured of PVC and stainless steel mesh. Preferably, a suction screen such as, but not limited to, McMaster part number 98755K23 (1996) is used. A ½ inch hose is attached to the output end of the full coupler in a manner known to those skilled in the art. The hose leads to the present compression gun and functions as a supply line.

Targets and the Wiring of the Targets

The various water guns are used in the preferred embodiment to direct a stream of water at other play participants or, alternatively, at the centralized target tower 104. The target tower 104 supports one or more actuating targets 110 for producing play effects, as discussed above. When a target 110 is contacted with a stream of water, the target causes a play effect to be activated for a preselected time duration. For example, the play participants can activate a play effect that replenishes their "ammunition" supply by contacting a specified target.

Figure 6:
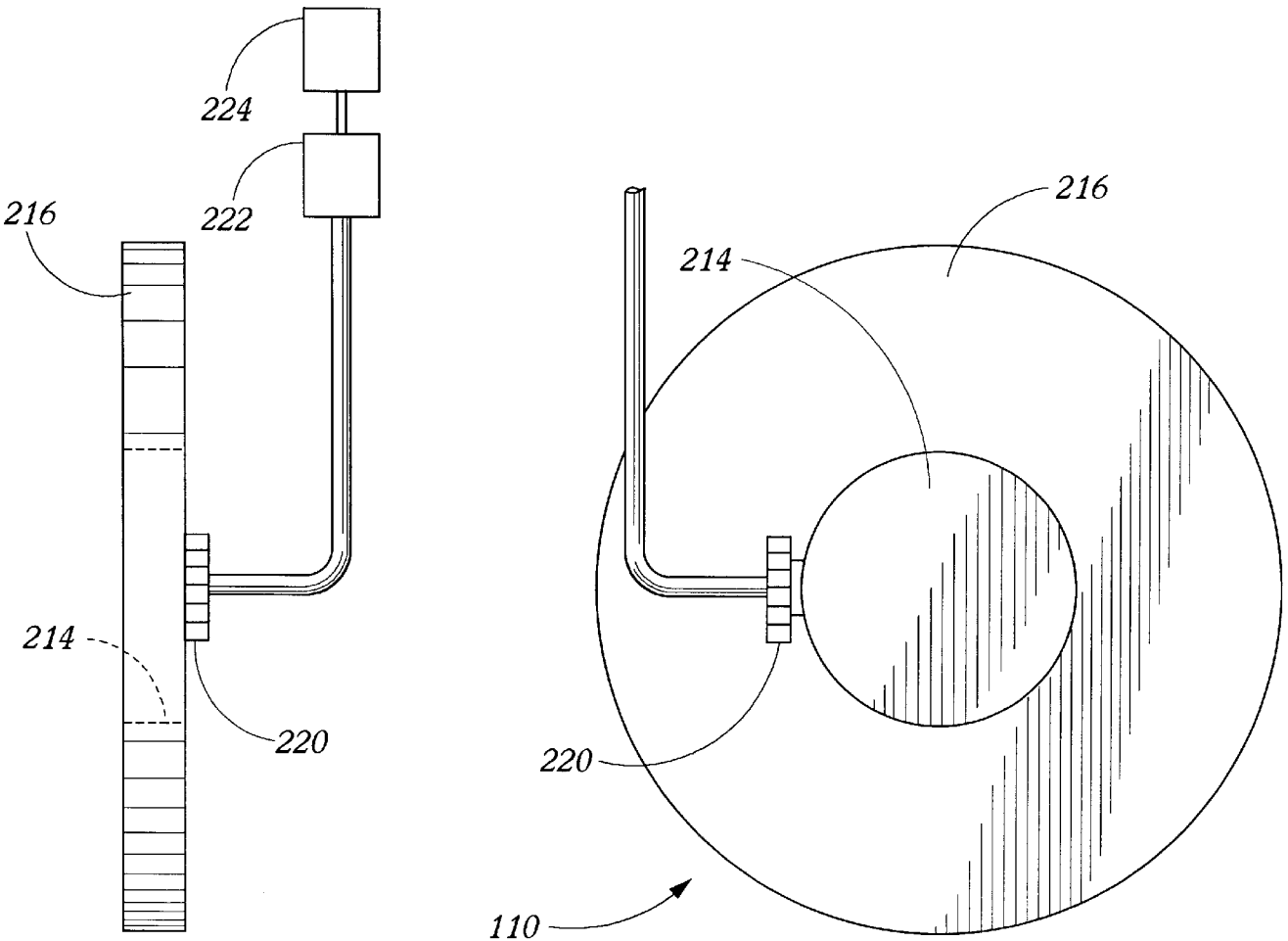
FIG. 6 is a target structure having features in accordance with the present invention.

As illustrated in FIG. 6, the present target 110 comprises a center bulls-eye gate portion 214 which is hinged to the balance of the target face 216. The gate 214 is preferably about 8 inches in diameter. The gate 214 is preferably engagingly connected to a limit switch 220 in a manner known to those skilled in the art. Those skilled in the art will also readily appreciate that other types of switches, such as, but not limited to, proximity switches, inertia switches and tilt switches, or various sensors may also be used.

The chosen electrical switch 220, presently a limit switch, is electrically connected to a control box 222. The control box 222 is in electrical communication with a relay which operates a solenoid valve 224. The solenoid valve 224 controls the flow of water to various water effects, such as, but not limited to, the central geyser 136, the jet sprayers 134, and the funnels 130. Thus, striking the target gate 214 will ultimately actuate a water effect. As discussed below, each target 110 controls a specific water effect or other play effect.

Tipping Buckets

Figure 7:
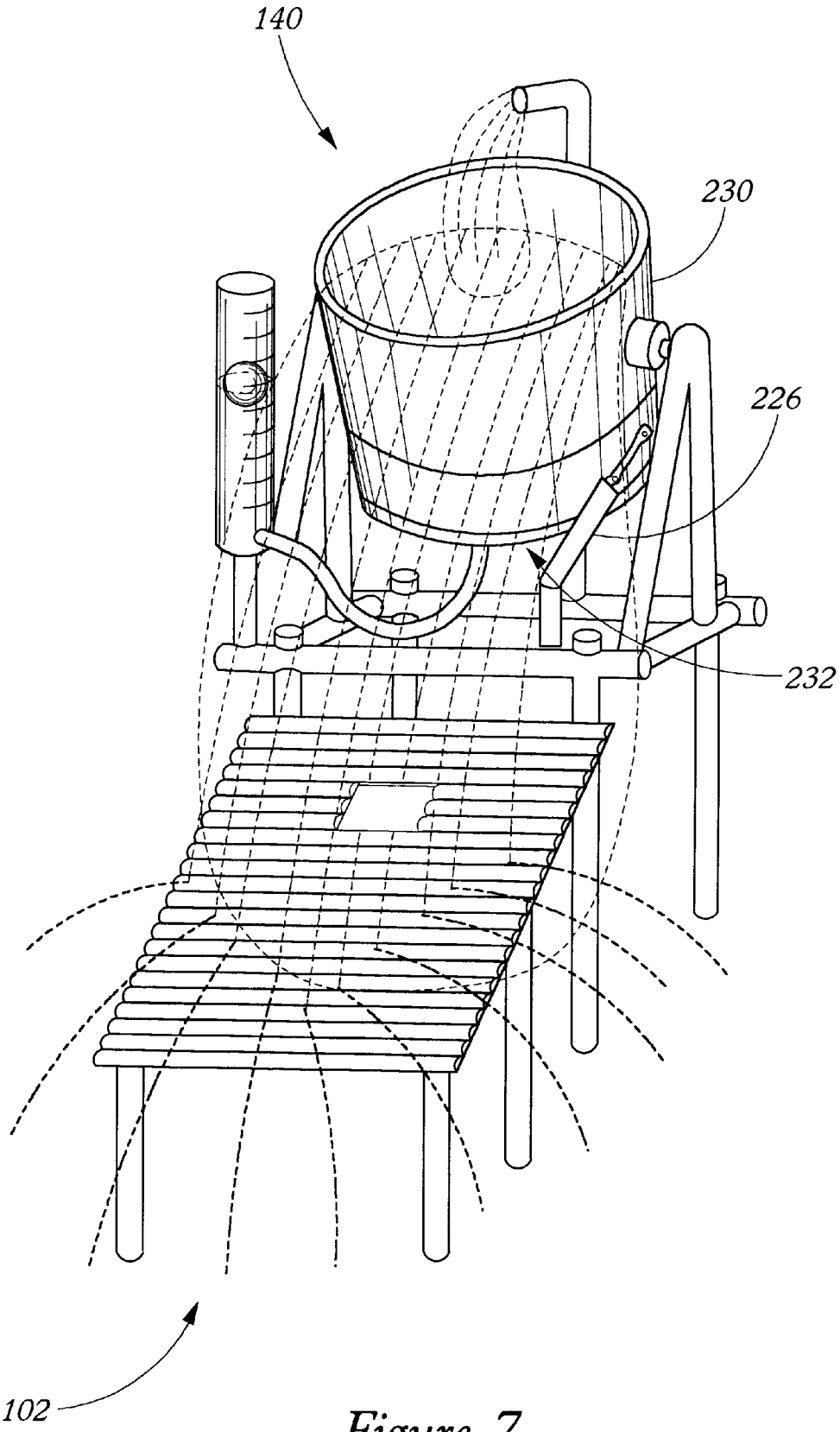
FIG. 7 is a perspective view of the tipping bucket of FIG. 1.

In one embodiment, a first set of play participants strike a specific target to activate a solenoid valve that causes a stream of water of short duration to be directed into a bucket 140 located above the play station 102 of a second set of play participants. When substantially filled, the bucket will spill its contents onto the play station of the second set of play participants. The present buckets are generally constructed in a manner well known to those skilled in the art. As shown in FIG. 7, the present bucket 140 is pivotably mounted above a play station 102. The lower portion of the bucket is pivotably attached to a pair of pneumatic arms 226. The other end of the arms 226 are pivotably fixed to the play station 102.

The bucket 140 is also provided with a float switch 230. The float switch 230 is activated by the rising water level in the bucket 140. Preferably, a float switch 230, such as, but not limited to a McMaster Carr #4909K63 side-wall mount float switch, is provided near the top of the bucket 140 to control the bucket dumping. The present float switch 230 has a single pole, double throw switch with magnetic snap action operation and is rated at 5 amps at 125/250 VAC, 60 Hz. The present side wall mount float switch is preferably installed through a 1 inch half coupling welded in the tank wall.

When the bucket water level reaches a predetermined tipping level, the float switch 230 activates and air is supplied to the pneumatic arms 226. The bucket 140 is tipped and then returned to upright by the arms 226. Presently, at least one pneumatic arm 226 is used to tip the bucket; however, many other means of tipping the bucket, such as gear motors, hydraulic arms and reversible motors may be used. Air is preferably supplied to the present pneumatic arm through a filter-regulator-lubricator with a metal bowl and a sight glass.

The present bucket 140 is also preferably provided with a service drain valve 232. The present drain valve 232 is comprised of a 1½ inch close nipple which is threaded into a 1½ inch brass ball valve. The close nipple may be connected to the lowest point of the bucket 140 through threading, welding or another connecting means. The drain 232 is desirably located in the lowest point of the bucket, however, if complete draining will not be required, it may be located elsewhere within the bucket walls.

As will be appreciated by one skilled in the art, many variations may be utilized to control the water release from the bucket, such as, but not limited to, switch activated flood gates, conditionally stable buckets having biased center of gravity locations, and false bottoms which open under increased loads or with switch activation.

Sprayers

Figure 8:
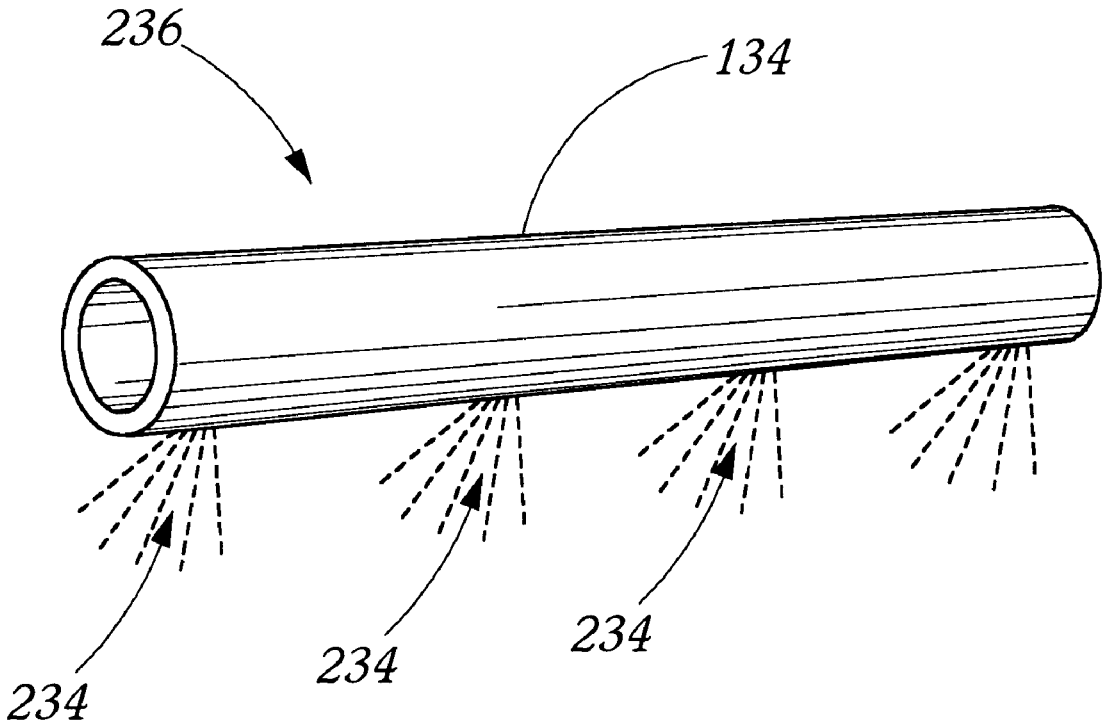
FIG. 8 is a perspective view of the jet sprayer of FIG. 1.

In another preferred embodiment, striking a target 110 facing a first play station 102 will cause a jet sprayer pipe 134 located on a second play station 102 to spray a plurality of streams of water of short duration directly onto play participants located on that second play station 102. The present jet sprayer pipe 134, as shown in FIG. 8, is formed by placing a plurality of nipple nozzles 234 into a horizontal pipe 236. The spacing and number of nipple nozzles can be varied to target the likely positions of play participants. Preferably, the nipple nozzles are recessed and mounted in a manner well known to those skilled in the art.

Funnels

In another preferred embodiment, striking the target 110 will activate a solenoid leading to one of the target tower legs 154 which will, in turn, force water from leg outlet 156 into a funnel 130 supported by a leg 154 of the target tower. The funnel 130 is connected to a pipe 132 which is aimed to release water over the runnel region (see FIG. 1).

The pipe 132 may be movable to deliver its payload of water over a location determined by play participants. Alternatively, nipple nozzles may be provided along the length of the pipe 132 to spray water over an increased region. The present pipe is located about seven feet above grade, but the height may be varied as desired. The present pipe is about eight feet in length, has an outer diameter of about 6 inches and a wall thickness of about ¼ inch. The length, diameter and wall thickness may be varied to allow the delivery of a desirable amount of water to a desirable location in a predetermined amount of time. One skilled in the art will readily appreciate the many variations which may be made to the funnel pipe while still remaining within the spirit of the invention. For example, but without limitation, the pipe 132 may be capped at the end with slots or holes along its length create a sprinkler or the pipe 132 may dump the water into yet another water play element.

Central Geyser

Figure 9:
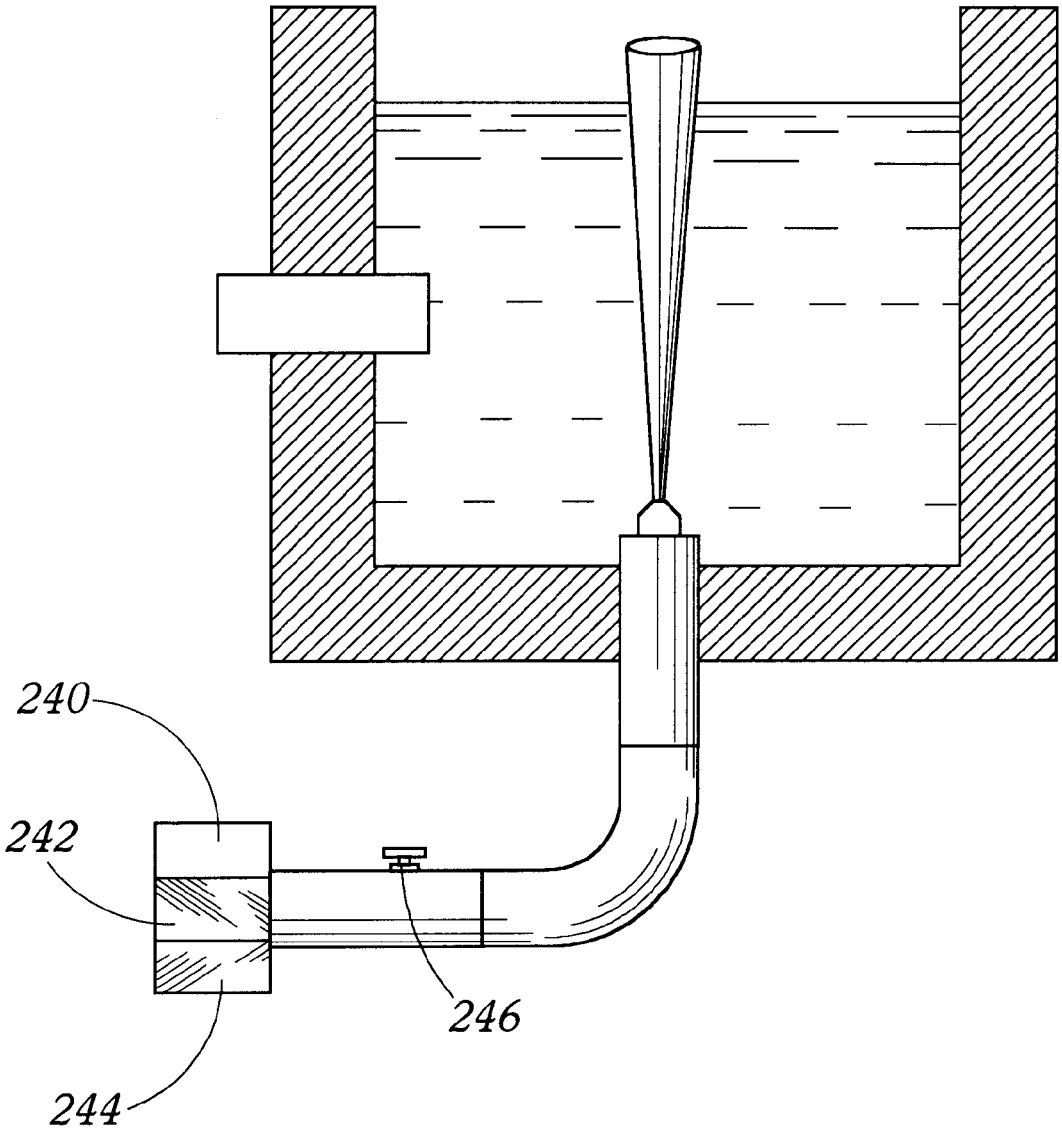
FIG. 9 is a side elevational view of the central geyser of FIG. 1.

In still another embodiment, striking a specific target 110 can have varied effects to reward precise shooting by the play participants. Multiple solenoid valves can be connected to a single water effect such that opening each valve successively will increase the intensity of the water effect when activated. In the preferred embodiment, three solenoid valves 240, 242 and 244 are connected to the center geyser as shown in FIG. 9. The central geyser is built using a nozzle in a manner well known in the art. Three targets 110 are connected to each solenoid valve 240. Hitting any one of the targets 110 will activate the first valve 240 for five seconds. The first valve 240 allows a water flow of approximately ⅓ of full flow. Hitting any of the targets 110 again within ten seconds will activate a second valve 242 such that a water flow of approximately ⅔ of full flow is created for five seconds. Finally, hitting any of the targets 110 again within ten seconds will activate a third valve 244 such that a full flow is achieved. However, failing to activate the second 242 or third valve 244 within the allotted ten seconds results in the water flow being shut down and the sequence resetting to the beginning. As will be appreciated by one skilled in the art, other variations of this timed sequence may also be used.

The ultimate geyser height is preferably controllable with a manually adjustable valve 246. As will be recognized by one skilled in the art, the geyser height may alternatively be automatically adjustable to suit each environment of use. The present geyser height is preferably about 12 to 18 feet but may be adjusted higher or lower. A lower height may be desirable, for example, in high wind conditions. Importantly, all three heights mentioned above may be adjusted either independently or together. For example, the present geyser has stages with heights of about 10 feet, about 15 feet, and about 20 feet.

Target Zone layout

Figure 10:
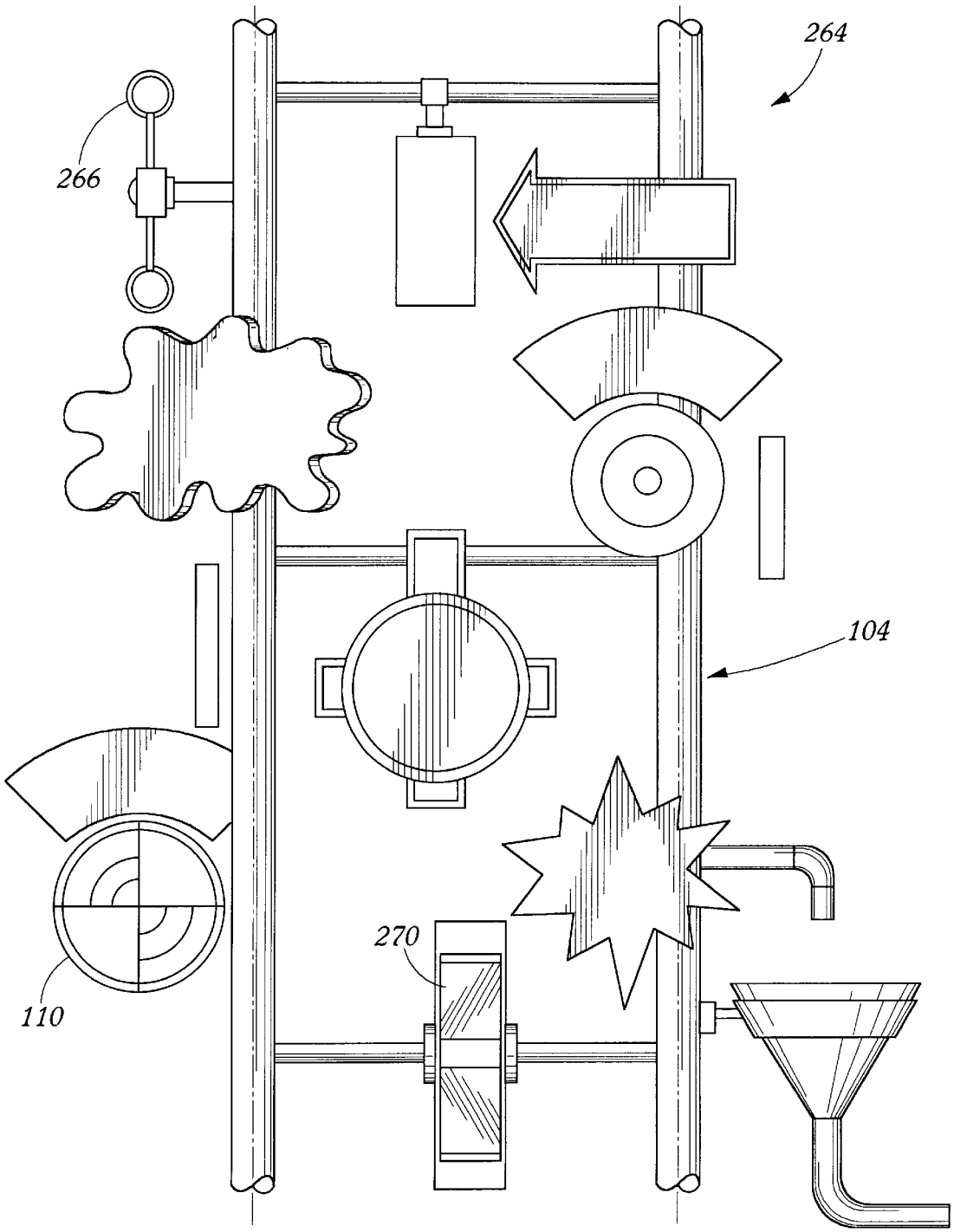
FIG. 10 is a partial sectional side elevational view of the target zone of FIG. 1.

FIG. 10 is an elevation view of the target zone 264 of the target tower 104 of the preferred embodiment. As discussed earlier, the preferred embodiment of the tower 104 utilizes a substantially triangular tower framework in cross-section with a face of the tower 104 generally parallel to the face of each of the three play stations 102. There are preferably six targets shown on each face of the target tower. As an example, the six targets comprising the face of the tower directed to a play station "A" are: "A" bucket fill, "B" bucket fill, "C" bucket fill, "B" tower spouts, "A" funnel, and the central geyser. Each of these water effects have been described in detail above.

Other Target Variations

In addition to an assortment of interactive targets 110, the target tower 104 can also contain a number of other targets which activate effects such as, but not limited to, bells, buzzers, lights, indicators, sound effects, and other similar items. For example, a target 110 can capture a stream of water from a water gun and redirect or break-up that stream to create a desired effect. As is evident from FIG. 10, the targets 110 can be varied in shape and type.

One target is shown as an anemometer 266. An anemometer 266 is typically used to measure and indicate the force and speed of the wind; however, in this case, the anemometer 266 is used to catch the flow of the stream of water. The anemometer 266 may be configured to activate a solenoid valve or other water effect; however, in a present embodiment, the anemometer 266 is merely a spinning target.

A similar target to the anemometer 266 is the paddle wheel 270. Water from the water stream shot from a water gun contacts the paddles of the paddle wheel 270. The force of the water stream on the paddle wheel paddles causes the paddle wheel 270 to rotate about a center shaft. The rotation can activate a solenoid valve and create a secondary water effect. Other targets can be spinners, funnels, and pressure sensitive contact surfaces. Those skilled in the art will recognize a wide variety of other types of targets can readily be used to create or activate other play or water effects.

Plumbing and Electrical Plan

Figure 11A:
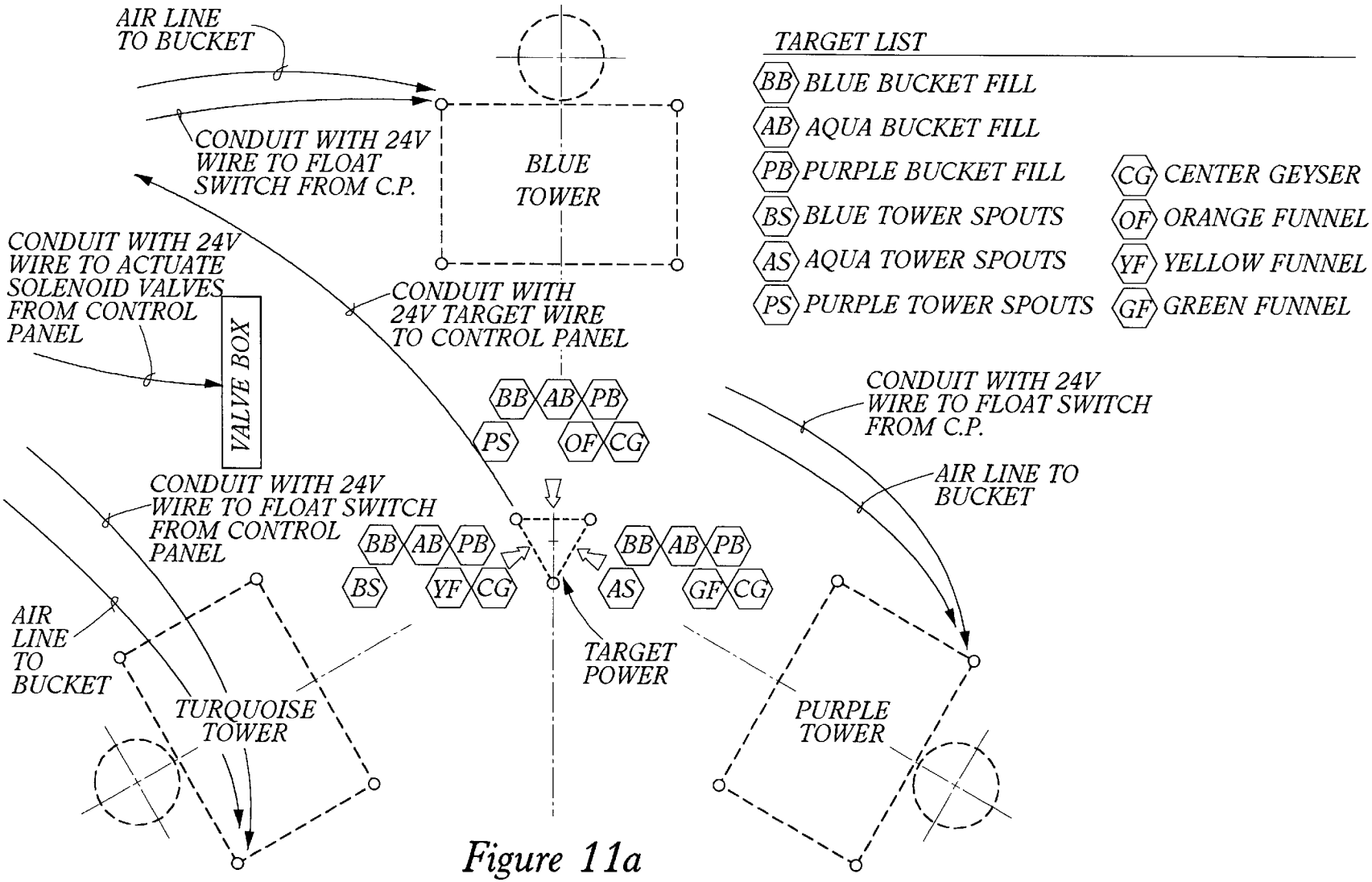
FIG. 11*a* is a top schematic plan view of the embodiment of FIG. 1 showing the electrical and air lines.
Figure 11B:
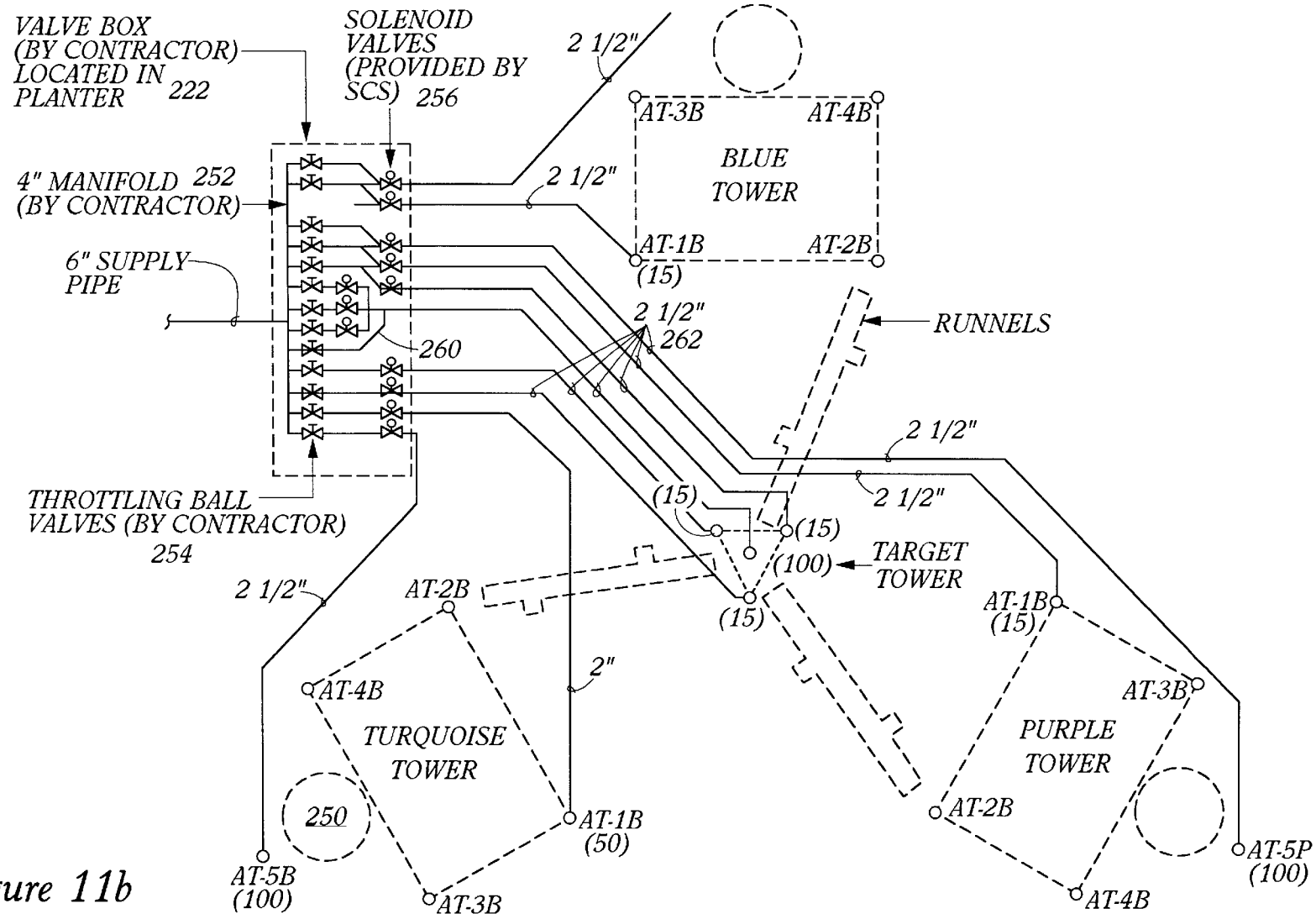
FIG. 11*b* is a top schematic plan view of the embodiment of FIG. 1 showing the water lines.

FIG. 11*b* is a plan view and plumbing schematic of the water play arena of FIG. 1. As indicated in FIG. 11*b,* water under pressure is provided to the various support conduits 146 by a system of subterranean supply conduits 152 running underneath the play stations 102. A catch basin (not shown) is provided adjacent the play stations 102 for collecting water runoff. In addition, drains (not shown) are desirably located at various locations around the play stations 102 to collect the runoff water. The precise number and placement of the drains can be varied, as desired, according to the size of the play stations and the contour of the underlying terrain.

It will be appreciated that runoff water flows into the various drains through the collection lines to the inlet port of the recirculation pump 250. Those skilled in the art will appreciate that the pump 250 can comprise any one of a number of commercially available pumps for pumping or recirculating water. An end-suction centrifugal or vertical turbine pump having a capacity of between about 1000 and 3000 gpm and a maximum head of between about 30 and 40 feet of water should be sufficient for most applications.

The pump 250 supplies the recirculated water at a predetermined head to a master control valve manifold 252, as shown. The manifold is adapted to safely deliver the returned water via subterranean supply conduits 152 to each of the vertical support conduits 146 and other outlets, such as the geyser 136. Advantageously, the (flow rate) of the water delivered to each of the outlets can be adjusted via control valves 254 for safely supplying recirculated water to the various interconnected water effects. Those skilled in the art will readily appreciate that the above construction provides efficient reuse of the water. This is desirable because, among other reasons, it reduces operating costs, promotes water conservation and avoids possibly damaging runoff water.

As shown in FIG. 11*b,* the manifold also contains several solenoid valves 256. As explained earlier, the targets 110 mounted on the target tower 104 are electrically connected with 24 volt wire to the present solenoid valves 256. Preferably, the targets 110 are connected to a control box 222. The control box 222 is then connected to the solenoid valves 256 through wire. As a target 110 activates, as described above, and sends a signal to the control box 222, the control box 222 will turn on a solenoid valve 256 and allow water to flow through the water conduits to a specified water effect described above.

In addition, FIG. 11*b* shows one supply conduit 260 not connected to a solenoid valve. This free flowing conduit 260 allows water to be steadily introduced into the center pond 106 through the geyser 136. Those skilled in the art will appreciate that other similar lines can be introduced into the play arena to create various water effects such as sprinkling lines, water falls, water fans, and misting stations, for example.

According to FIG. 11*b,* pipes of various sizes and containing various water pressures are used in the preferred embodiment. In particular, the entire manifold 252 is preferably supplied by a 6 inch supply pipe 262 which feeds a four inch manifold 252. The manifold 252 then supplies water to pipes preferably 2½ inches in diameter which supply a flow of water at about 100 psi to the water play elements, such as, for example, but without limitation, the buckets and the geyser. The manifold 252 also supplies water to other pipes preferably 1½ inches in diameter. These pipes supply a flow of water at about 15 psi to the station jet sprayers 134, the funnel 130 and other water play elements.

Although this invention has been disclosed in the context of certain preferred embodiments, it will be understood by those skilled in the art that the present invention extends beyond the specifically disclosed embodiments to other alternative embodiments and obvious variations of the invention. Thus, it is intended that the scope of the present invention herein disclosed should not be limited by the particular proffered embodiments described above, but should be determined only by a fair reading of the claims that follow.

What is claimed is:

1. A water play attraction comprising:

one or more play stations for safely supporting play participants playing in, on or around said one or more play stations;

one or more water play elements disposed in, on or around said one or more play stations and being arranged and adapted to be manipulated or controlled by play participants to create one or more desired effects; and one or more target structures disposed in the vicinity of said one or more play structures and having one or more interactive targets adapted to be activated by said one or more effects, said one or more interactive targets being further adapted when activated to open or close a valve or electric circuit to create a further desired effect.

2. The water play attraction of claim 1 wherein at least one of said one or more play stations comprises a multi-level play station upon which play participants may climb.

3. The water play attraction of claim 1 wherein said one or more play stations comprises a plurality of multi-level play stations arranged about a central target structure.

4. The water play attraction of claim 3 wherein said plurality of play stations comprise three multi-level play stations substantially equally spaced and arranged substantially concentrically about a central target structure.

5. The water play attraction of claim 1 wherein at least one of said one or more play elements comprises a play-participant-operated water forming element arranged and configured to allow play participants to direct a stream of water at said one or more target structures.

6. The water play attraction of claim 5 wherein said water forming element comprises a pump gun arranged and configured to allow play participants to direct a stream of water at said one or more target structures.

7. The water play attraction of claim 1 wherein at least one of said one or more play elements comprises adjustable water jets, spray nozzles, pump guns, geysers or tipping buckets.

8. The water play attraction of claim 1 wherein at least one of said one or more play elements is adapted and arranged to create a desired effect comprising spraying, spilling, bubbling, pouring, or splashing water or other liquid play medium, or ringing bells, sounding buzzers, spinning wheels, or turning on and off lights.

9. The water play attraction of claim 1 wherein at least one of said one or more play elements is adapted and arranged to create a desired effect comprising a multiple-order water effect.

10. The water play attraction of claim 1 wherein at least one of said one or more play elements is adapted and arranged to create a desired effect comprising a delayed effect.

11. The water play attraction of claim 1 wherein at least one of said one or more play elements is adapted and arranged to create a desired effect comprising a progressing intensity effect.

12. The water play attraction of claim 1 wherein at least one of said one of said target structures comprises a centrally disposed target tower.

13. The water play attraction of claim 12 comprising multiple play stations arranged generally about a central target structure and wherein said target structure comprises a target tower having multiple sides corresponding to the number of said multiple play stations and facing substantially toward each said play station.

14. The water play attraction of claim 13 wherein each side of said central target tower is substantially similar to each other side such that play participants at each said play station can compete with one another on a substantially equal basis in activating said one or more interactive targets disposed on said target structure.

15. The water play attraction of claim 14 wherein each play station includes an identifying color or other identifying indicator and wherein said one or more interactive targets are designated using corresponding identifying colors or identifying indicators and wherein each said designated interactive target is adapted to cause a desired effect on or adjacent to its corresponding identified play station.

16. The water play attraction of claim 15 wherein each play station further comprises a tipping bucket disposed on top of each play station and adapted to fill with water and to spill when the water in the bucket reaches a predetermined level and wherein at least one of said designated interactive targets is adapted to cause the tipping bucket on the corresponding identified play station to fill with water, whereby play participants at each play station can compete to fill the buckets on each play station.

17. A kit for constructing a water play attraction comprising:

a first plurality of support members adapted to be assembled with one another to form one or more play stations for safely supporting play participants playing in, on or around said one or more play stations;

one or more water play elements adapted to be disposed in, on or around said one or more play stations, said water play elements being further adapted to be manipulated or controlled by play participants to create one or more desired effects;

a second plurality of support members adapted to be assembled with one another to form one or more target structures disposed in the vicinity of said one or more play structures; and a plurality of interactive targets adapted to mounted on said one or more target structures, said interactive targets being further adapted to be activated by said one or more effects and, in response, to open or close a valve or electric circuit to create a desired effect.

18. The kit of claim 17 wherein at least one of said one or more play stations comprises a multi-level play station upon which play participants may climb.

19. The kit of claim 17 wherein said one or more play stations comprises a plurality of multi-level play stations arranged about a central target structure.

20. The kit of claim 19 wherein said plurality of play stations comprise three multi-level play stations adapted to be substantially equally spaced and arranged generally about a central target structure.

21. The kit of claim 17 wherein at least one of said one or more play elements comprises a play-participant-operated water forming element arranged and configured to allow play participants to direct a stream of water at said one or more target structures.

22. The kit of claim 21 wherein said water forming element comprises a pump gun arranged and configured to allow play participants to direct a stream of water at said one or more target structures.

23. The kit of claim 17 wherein at least one of said one or more play elements comprises adjustable water jets, spray nozzles, pump guns, geysers or tipping buckets.

24. The kit of claim 17 comprising a plurality of play stations and wherein each play station has associated with it a delayed water effect adapted to accumulate water and to spill or create other desired effects when the accumulated water reaches a predetermined level, whereby play participants at each play station can compete to activate said delayed water effect associated with each play station.

25. A play attraction comprising:

a plurality of play stations for safely supporting play participants playing in, on or around said one or more play stations;

one or more play elements disposed in, on or around each said play station and being arranged and adapted to be manipulated or controlled by play participants to create one or more desired effects; and at least one target structure disposed in the vicinity of said play structures and having one or more interactive targets adapted to be activated by said one or more effects, said one or more interactive targets being further adapted when activated to open or close a valve or electric circuit and/or to create one or more desired effects.

26. The play attraction of claim 25 comprising at least three play stations arranged generally about a central target structure and wherein said target structure comprises a target tower having multiple sides corresponding to the number of said play stations and facing substantially toward each said play station.

27. The play attraction of claim 26 wherein each side of said central target tower is substantially similar to each other side such that play participants at each said play station can compete with one another on a substantially equal basis in activating said one or more interactive targets disposed on said target structure.

28. The play attraction of claim 27 wherein each play station includes an identifying color or other identifying indicator and wherein said one or more interactive targets are designated using corresponding identifying colors or identifying indicators and wherein each said designated interactive target is adapted to cause a desired effect on or adjacent to its corresponding identified play station.

29. The play attraction of claim 15 wherein each play station has associated with it a delayed effect adapted when activated to create one or more desired effects, said delayed effect being responsive to cumulative activations of said interactive targets, wherein each said designated interactive target is adapted to contribute to causing the delayed effect associated with each corresponding identified play station to be activated, whereby play participants at each play station can compete to activate the delayed effects associated with each play station.

30. A water play attraction comprising:

one or more play stations for safely supporting play participants playing in, on or around said one or more play stations;

one or more water play elements disposed in, on or around said one or more play stations and being arranged and adapted to be manipulated or controlled by play participants to direct a stream of water; and one or more target structures disposed in the vicinity of said one or more play structures and having one or more interactive targets adapted to be activated by said stream of water to create desired play effects.

31. The water play attraction of claim 30 wherein at least one of said one or more play stations comprises a multi-level play station upon which play participants may climb.

32. The water play attraction of claim 30 wherein said plurality of play stations comprise three or more multi-level play stations generally arranged about a central target structure.

33. The water play attraction of claim 30 wherein at least one of said water play elements comprises a pump gun arranged and configured to allow play participants to direct a stream of water at said one or more target structures.

34. The water play attraction of claim 30 wherein at least one of said interactive targets is adapted to create play effects comprising spraying, spilling, bubbling, pouring, or splashing water or other liquid play medium, or ringing bells, sounding buzzers, spinning wheels, or turning on and off lights.

35. The water play attraction of claim 30 wherein at least one of said interactive targets is adapted to create play effects comprising a multiple-order water effect.

36. The water play attraction of claim 30 wherein at least one of said interactive targets is adapted to create play effects comprising a delayed effect.

37. The water play attraction of claim 30 wherein at least one of said interactive targets is adapted to create play effects comprising a progressing intensity effect.

38. The water play attraction of claim 37 wherein said progressing intensity effect comprises a variable intensity water geyser.

39. The water play attraction of claim 30 wherein each play station includes an identifying color or other identifying indicator and wherein said one or more interactive targets are designated using corresponding identifying colors or identifying indicators and wherein each said designated interactive target is adapted to cause a desired effect on or adjacent to its corresponding identified play station.

40. The water play attraction of claim 39 wherein each play station further has associated with it a delayed water effect adapted to accumulate water and to spill or create desired effects when the accumulated water reaches a predetermined level, whereby play participants at each play station can compete to activate said delayed water effect associated with each play station.

41. The water play attraction of claim 39 wherein each play station further comprises a tipping bucket disposed on top of each play station adapted to fill with water and to spill when the water in the bucket reaches a predetermined level and wherein each said designated interactive target is adapted to cause the tipping bucket on the corresponding identified play station to fill with water, whereby play participants at each play station can compete to fill the buckets on each play station.

* * * * *